US007762772B1

(12) United States Patent
Alby et al.

(10) Patent No.: US 7,762,772 B1
(45) Date of Patent: Jul. 27, 2010

(54) MARINE PROPELLER WITH SPEED SENSITIVE VENTING

(75) Inventors: Jeremy L. Alby, Oshkosh, WI (US); Daniel J. Guse, Fond du Lac, WI (US); Edward M. Thull, Omro, WI (US); Terence C. Reinke, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 795 days.

(21) Appl. No.: 11/726,929

(22) Filed: Mar. 23, 2007

(51) Int. Cl.
*B64C 11/00* (2006.01)

(52) U.S. Cl. ..... 416/45; 416/93 A; 416/244 B; 440/89 A

(58) Field of Classification Search ..... 416/25, 416/26, 30, 31, 44, 45, 46, 90 A, 93 A, 245 A, 416/244 B; 440/66, 89 A; 415/25, 26, 30, 415/31

See application file for complete search history.

(56) References Cited

U.S. PATENT DOCUMENTS

| | | | | |
|---|---|---|---|---|
| 3,754,837 A | 8/1973 | Shimanckas | ..... | 416/93 |
| 4,545,771 A * | 10/1985 | Iio | ..... | 440/89 R |
| 4,802,872 A * | 2/1989 | Stanton | ..... | 440/89 R |
| 5,916,003 A | 6/1999 | Masini et al. | ..... | 440/89 |
| 6,375,528 B1 * | 4/2002 | Neisen | ..... | 440/89 R |
| 7,056,091 B2 | 6/2006 | Powers | ..... | 416/93 A |

* cited by examiner

*Primary Examiner*—Edward Look
*Assistant Examiner*—Ryan H Ellis
(74) *Attorney, Agent, or Firm*—Wiliam D. Lanyi

(57) ABSTRACT

A marine propeller is provided with a valve that progressively blocks exhaust flow into aerating relation with the blades of the propeller as the propeller rotational speed increases. A piston within a housing moves radially outwardly, in response to centrifugal forces, as the propeller increases in rotational speed. This movement progressively blocks an aperture that allows the flow of exhaust gas into the region of the propellers. In certain embodiments, a secondary flow path is allowed even when the piston has moved to its extreme outward radial position.

15 Claims, 10 Drawing Sheets

MARINE PROPELLER WITH SPEED SENSITIVE VENTING

BACKGROUND OF THE INVENTION

1. Field of the Invention

The present invention is generally related to a marine propeller and, more particularly, to a marine propeller that is provided with one or more vents which aerate the blades of the propeller at a rate which is an inverse function of the rotational speed of the propeller.

2. Description of the Related Art

U.S. Pat. No. 3,754,837, which issued to Schimanckas on Aug. 28, 1973, describes a variably ventilated propeller. A propulsion device comprises a propeller shaft supported by a lower unit and extending rearwardly through an exhaust gas opening in the lower unit, a propeller having a hub adapter for discharging exhaust gas therethrough and mounted on the rearwardly extending propeller shaft for common rotary movement with the propeller shaft and for axial movement relative to the propeller shaft between a first, forwardly located position and a second position located rearwardly of the forward position with a propeller spaced axially rearwardly of the lower unit exhaust gas opening. It also comprises means for biasing the propeller toward the rearward position.

U.S. Pat. No. 4,545,771, which issued to Iio on Oct. 8, 1985, describes a propeller and exhaust system for an outboard motor. The performance is improved by permitting the flow of some exhaust gases in proximity to the propeller blades at low speeds so as to aerate this area and so as to preclude the aeration when the speed of the propeller exceeds a predetermined speed for improving thrust.

U.S. Pat. No. 4,802,872, which issued to Stanton on Feb. 7, 1989, describes a regulated aeration of gases exhausting through a propeller. Aeration holes defined by an outer propeller hub include closure devices which seal the aeration holes during rotation of the propeller due to centrifugal forces in a predetermined speed of rotation range. The aeration holes provide high power at low boat speeds and are sealed at high boat speeds to avoid further aeration and loss of forward thrust. The speed of rotation at which the aeration holes are sealed is adjustable.

U.S. Pat. No. 5,916,003, which issued to Masini et al. on Jun. 29, 1999, discloses a propeller vent plug with fluid passage. A propeller device is provided with vent apertures and plugs which fit into the vent apertures to be retained in position during use of the propeller device. The vent plugs are provided with openings therethrough so that fluids can flow from a region within a hub of the propeller device to a region proximate the outer cylindrical surface of the hub. The fluids flowing from the internal portion of the hub flow towards regions of low pressure near the propellers. The plugs can be changed to modify the size of the ventilation aperture without having to change the propeller device itself. One embodiment of the plug is provided with a movable cover that closes the opening progressively in response to increasing rotational speed of the propeller device.

U.S. Pat. No. 6,375,528, which issued to Neisen on Apr. 23, 2002, describes adjustable variable vent opening plugs for engine exhaust. The plug includes a main body configured to be secured within an opening in a wall of a gear case in flow communication with an exhaust passageway through the gear case. The vent plug main body includes a flow passage therethrough and a planar flow restriction member extends across the flow passage that includes an opening. The main body also includes a variable flow restriction member chamber having an annual groove extending around the chamber. A variable flow restriction member is located within the chamber and includes an opening having the same diameter as the diameter of the opening in the flow restriction member. The variable flow restriction chamber is movable within the chamber groove to adjust an amount of exhaust passing through the openings of the flow restriction member and the variable flow restriction member.

U.S. Pat. No. 7,056,091, which issued to Powers on Jun. 6, 2006, describes a propeller hub assembly having overlap zone with optional removable exhaust ring and sized ventilation plugs. A propeller hub assembly is provided with a through hub exhaust propeller hub characterized by an interior overlap zone defined by the composite interior dimensions of a selected number of conventional propeller hubs and optionally fitted with removable exhaust ring and/or sized ventilation plugs. The hub assembly of this invention includes specially designed driver adapters for insertion in the overlap zone of a universal propeller hub and accommodating corresponding conventional OEM factory thrust washers normally used in the conventional propeller hubs.

The patents described above are hereby expressly incorporated by reference in the description of the present invention.

SUMMARY OF THE INVENTION

A marine propeller, made in accordance with a preferred embodiment of the present invention, comprises an outer hub, a plurality of blades extending from the outer hub in a radial direction, an inner hub attached to the outer hub, an opening extending radially through the outer hub, and a valve disposed in the opening and extending into a passage between the inner and outer hubs.

In a preferred embodiment of the present invention, the inner and outer hubs are configured to be coaxial with each other and also with an axis of rotation of the marine propeller. The inner and outer hubs are configured to define the passage therebetween which, in a preferred embodiment, is a cylindrical and annular passage. The valve comprises a piston that is slidably disposed in a central cavity of the housing. A resilient member is disposed within the cavity and configured to urge the piston in a direction radially inward toward the axis of rotation of the propeller. The housing has an aperture formed through a cylindrical wall of the housing. The aperture connects the passage in fluid communication with the central cavity of the housing. The aperture and the piston are configured to cause the piston to progressively block the aperture in response to movement of the piston away from the axis of rotation. The housing has a first end and a second end. The first end is disposed farther from the axis of rotation than the second end. The housing has a first port formed through the first end. The first port is configured to connect the central cavity with a region radially outward from the outer hub. This region is proximate the outer cylindrical surface of the outer hub.

In a preferred embodiment of the present invention, the housing has a second port formed through the second end. The piston can have a vent formed through its thickness. The housing can have a circular cross section and the resilient member can be a coil spring disposed within the housing between the piston and the first end. The housing can comprise a first portion which, in turn, comprises the first end, and a second housing portion which, in turn, comprises the second end. The first and second portions of the housing are removably attachable to each other. The first housing portion is shaped to be received within the opening in the outer hub in a direction toward the axis of rotation from a position radially outward from the outer hub. The second portion of the housing is shaped to be moved into attachment with the first portion of the housing in a direction away from the axis of rotation from a position radially inward from the outer hub. The housing is spaced apart from the inner hub in a preferred embodiment of the present invention and is configured to provide first and second flow paths between the passage and the region radially outward from the outer hub. The first flow path extends through the aperture and the second flow path extends through the vent formed in the piston. The first and second flow paths can operate simultaneously in a preferred embodiment of the present invention. Typically, the second flow path can also operate when the first flow path is blocked by the piston which is moved radially outward in blocking association with the aperture.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
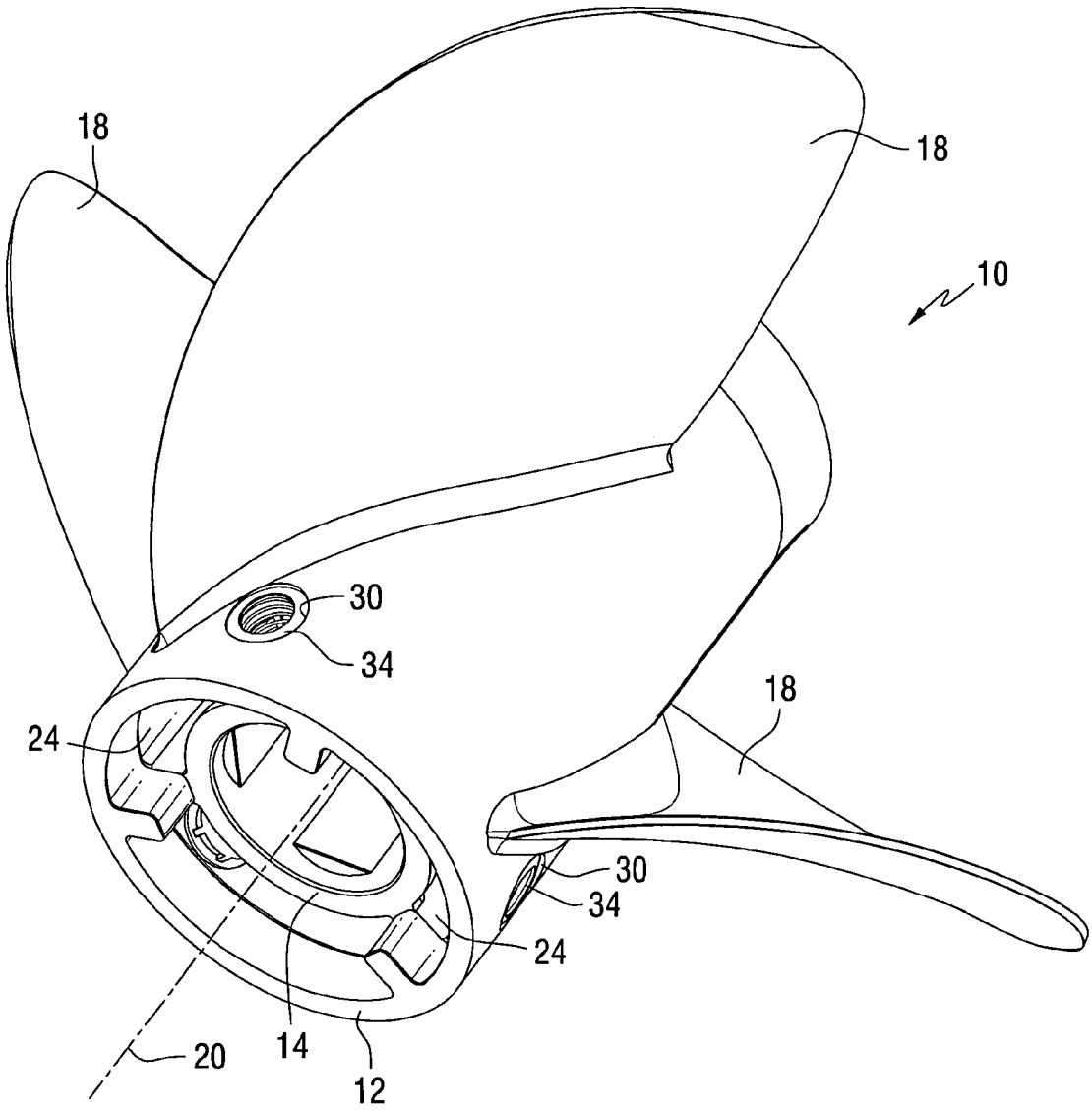
FIG. 1 is an isometric view of a marine propeller incorporating the present invention.

Throughout the description of the preferred embodiment of the present invention, like components will be identified by like reference numerals.

FIG. 1 shows a propeller 10 which comprises an outer hub 12 and an inner hub 14. A plurality of blades 18 extend from the outer hub 12 in a radially outward direction as shown in FIG. 1. The inner and outer hubs, 14 and 12, are configured to be coaxial with each other and also with an axis of rotation 20 of the marine propeller 10. The inner and outer hubs, 14 and 12, define a passage 24 therebetween. An opening 30 extends radially through the outer hub 12. A valve 34 is disposed within the opening.

Figure 2:
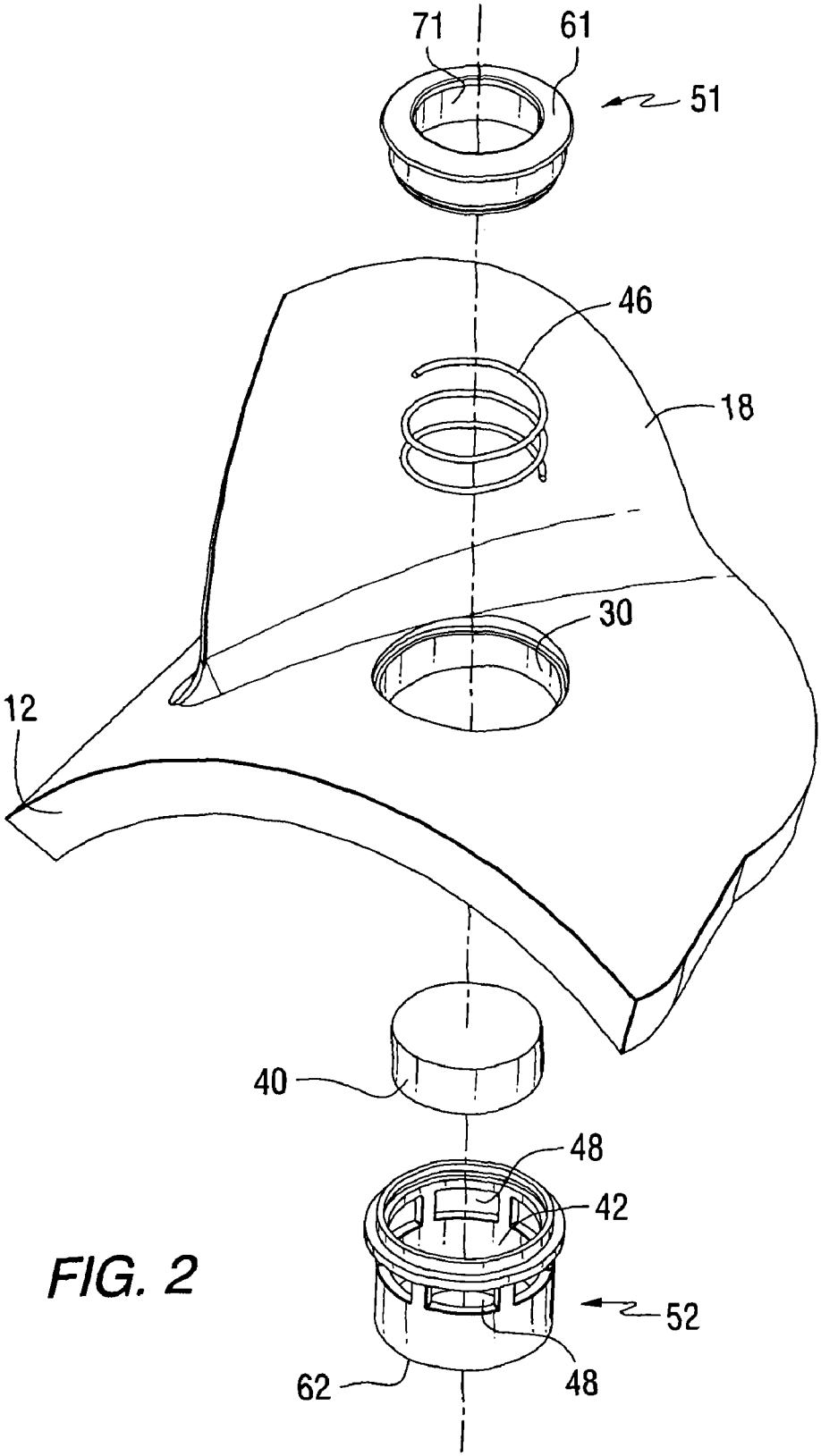
FIG. 2 is an exploded isometric view showing the various individual parts is of the valve of the present invention.

FIG. 2 is an exploded isometric view of a portion of the propeller 10 illustrated in FIG. 1. With reference to FIGS. 1 and 2, the valve 34 comprises a piston 40 that is slidably disposed in a central cavity 42 of the housing. A resilient member 46 is disposed within the cavity 42 and configured to urge the piston 40 in a radially inward direction toward the axis of rotation 20. The housing is provided with an aperture 48 formed through the housing. In a preferred embodiment of the present invention, the housing comprises a first portion 51 and a second portion 52. The first portion 51 comprises a first end 61 and the second portion 52 comprises a second end 62. The first and second portions, 51 and 52, are removably attachable to each other in a particularly preferred embodiment of the present invention. The aperture 48 can comprise a plurality of holes formed in the cylindrical wall of the housing.

With continued reference to FIGS. 1 and 2, the aperture 48 connects the passage 24 in fluid communication with the central cavity 42 of the housing. The aperture 48 and the piston 40 are configured to cause the piston 40 to progressively block the aperture 48 in response to movement of the piston 40 away from the axis of rotation 20. The housing, as described above, has a first end 61 and a second end 62. The housing has a first port 71 formed through the first end 61. The first port 71 is configured to connect the central cavity 42 in fluid communication with a region radially outward from the outer cylindrical surface of the outer hub 12. The opening 30 is configured to receive the housing therein.

Figure 3:
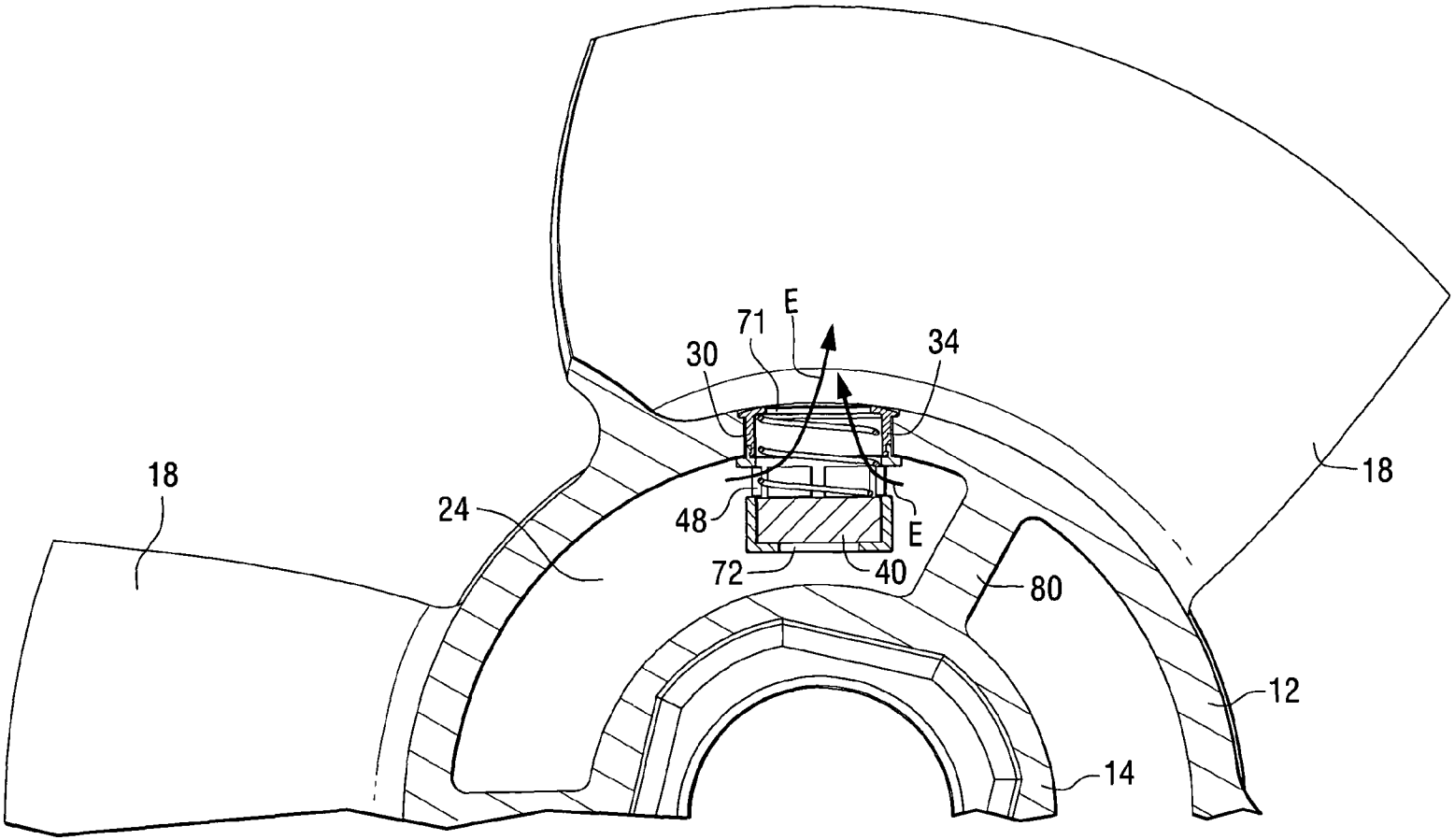
FIG. 3 is a section view of a stationary propeller with the present invention.
Figure 4:
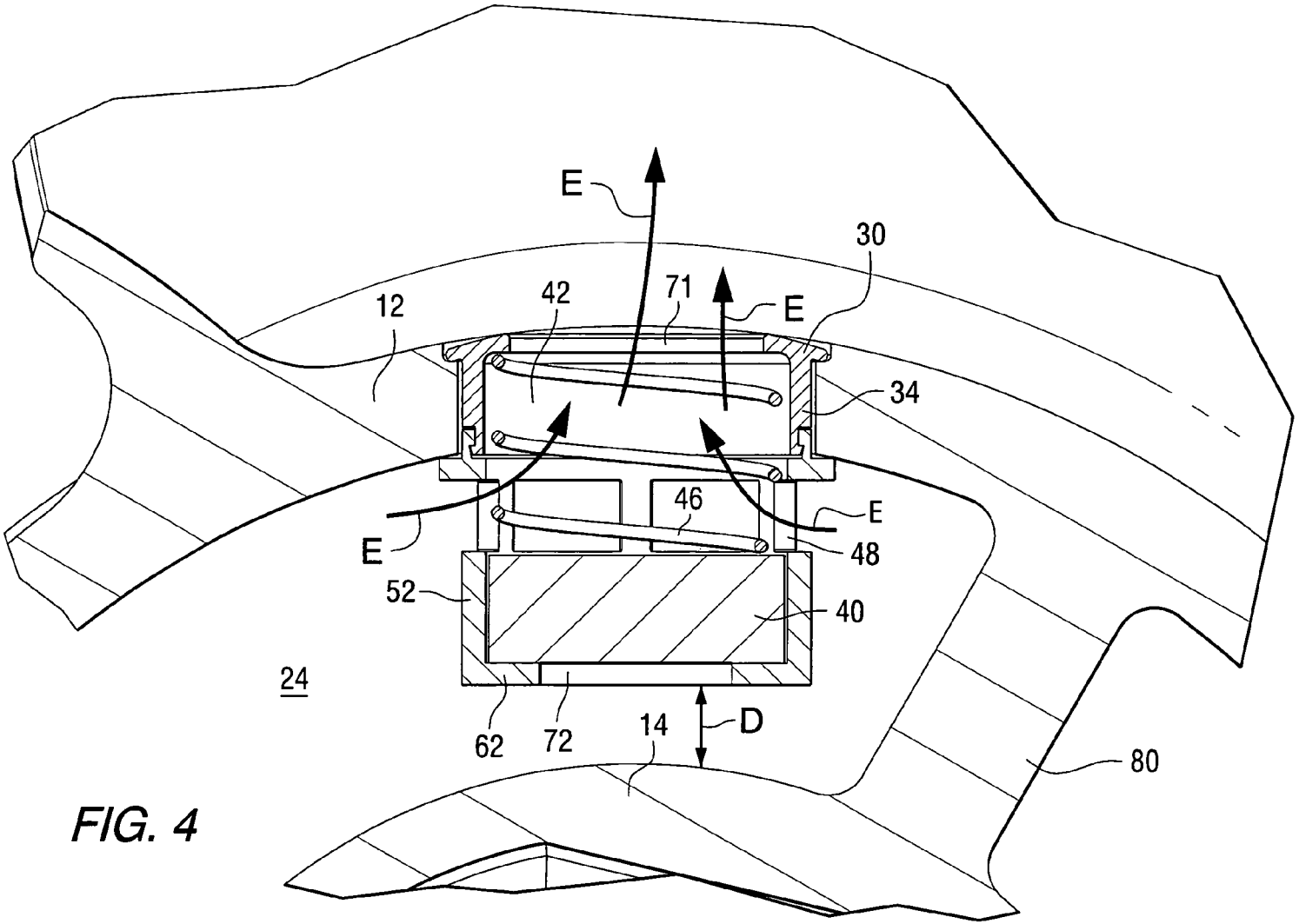
FIG. 4 is an enlarged view of the present invention illustrated in FIG. 3.

FIG. 3 is a section view of the propeller 10 showing the valve 34 disposed in the opening 30 and extending into the passage 24. The outer hub 12 is connected to the inner hub 14 by a plurality of ribs 80. FIG. 4 is an enlarged view of the portion of FIG. 3 showing the valve 34.

With continued reference to FIGS. 2, 3 and 4, the first and second housing portions, 51 and 52, are assembled together. The combined housing extends through the opening 30 into the passage 24. It can be seen that, in a preferred embodiment of the present invention, the second end 62 of the second housing portion 52 is displaced from the inner hub 14 by a distance identified by arrow D. A second port 72 is formed through the second end 62 as shown. The piston 40 is urged toward the axis of rotation (identified by reference numeral 20 in FIG. 1) by the resilient member 46 which, in a preferred embodiment of the present invention, is a coil spring as shown.

With continued reference to FIGS. 1-4, the piston 40 can move radially outward away from the axis of rotation 20 in response to the rotation of the propeller 10. This radially outward movement is against the force provided by the resilient member 46. When in the position shown in FIG. 4, the piston 40 does not block the aperture 48 and, as a result, exhaust gas can pass from the passage 24 through the aperture 48 into the central cavity 42 and through the first port 71 as represented by arrows E.

Figure 5:
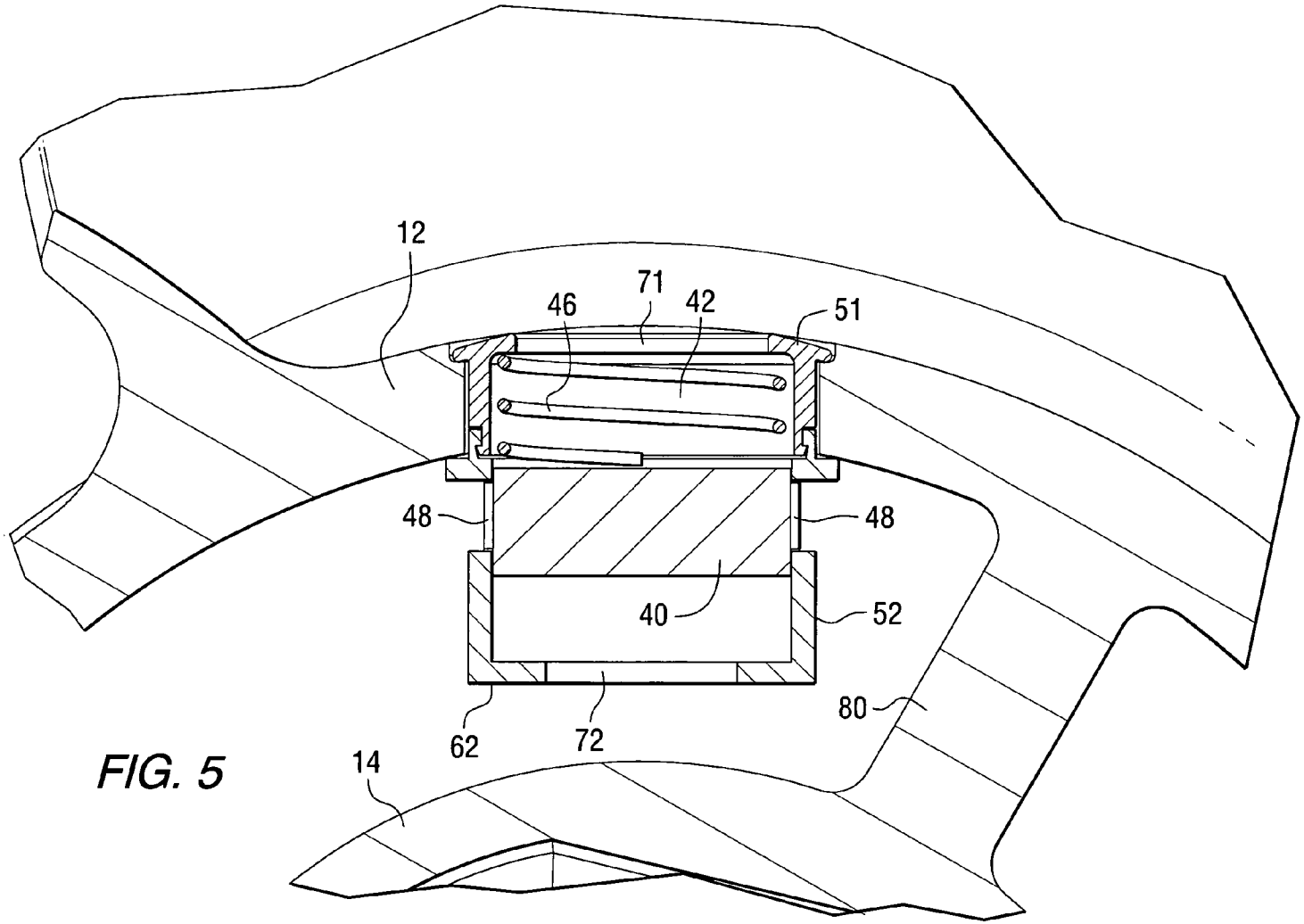
FIG. 5 is an enlarged view of the present invention when the propeller is rotating.

FIG. 5 is generally similar to FIG. 4, but shows the piston 40 moved radially outward, away from the axis of rotation of the propeller, to block the aperture 48. The centrifugal force exerted on the piston 40 causes it to move to the position shown in FIG. 5 against the force of the resilient member 46. This blocks the aperture 48 and prevents exhaust gas from passing into the central cavity 42 of the housing.

Figure 6:
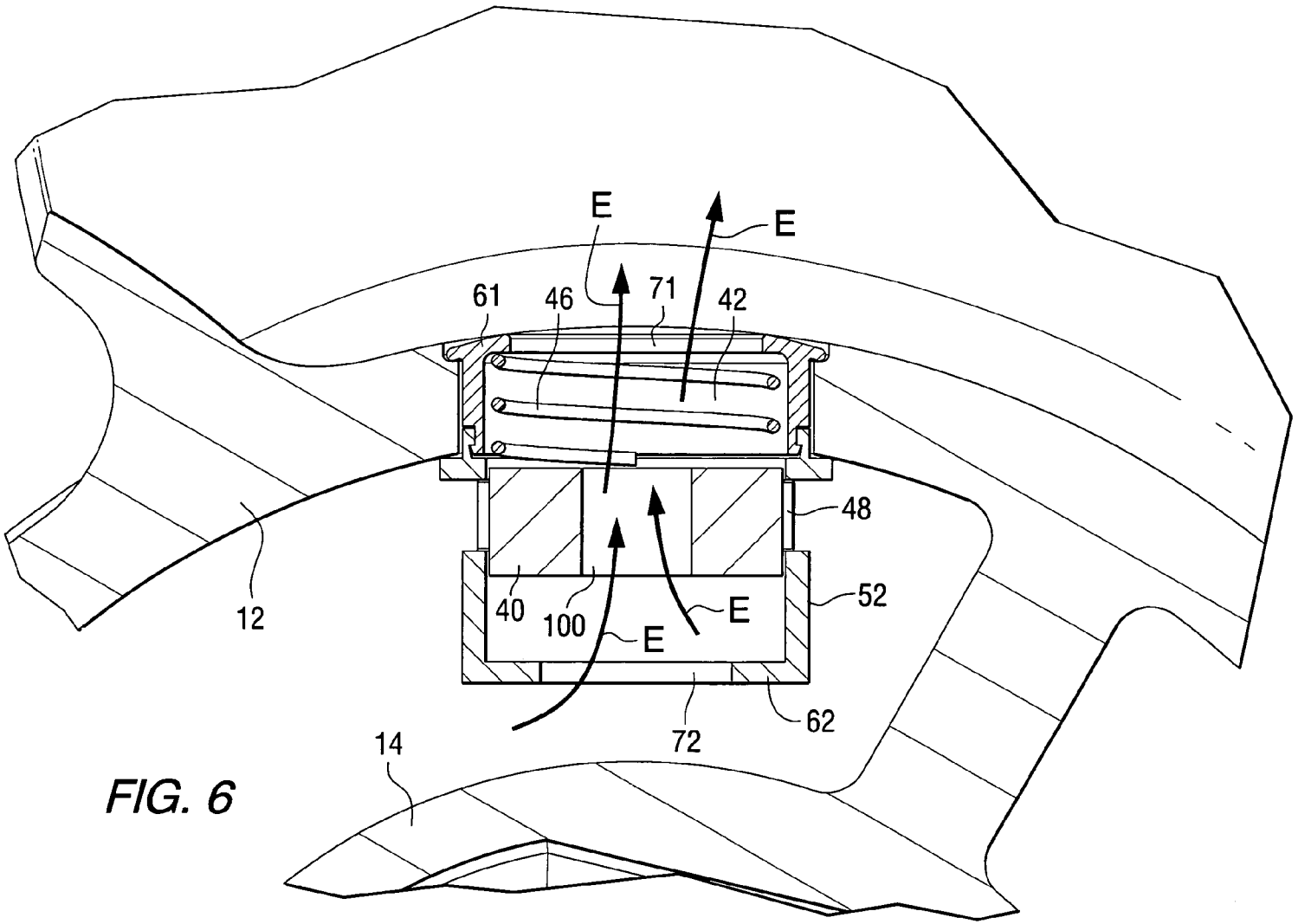
FIG. 6 is an enlarged view of an alternative embodiment of the piston of the present invention.

FIG. 6 shows an alternative embodiment of the present invention. In the embodiment shown in FIG. 6, the piston 48 is provided with a vent 100 through its thickness. When the piston 40 moves into blocking association with the aperture 48, a continued flow of exhaust gas can still pass through the second port 72 in the second end 62, through the vent 100 formed in the piston 40, and through the first port 71 formed in the first end 61 of the housing.

With continued reference to FIGS. 4-6, it should be understood that although the piston 40 is shown in either a non-blocking or blocking association with the aperture 48, many intermediate positions are possible as the piston moves from the position shown in FIG. 4 to the position shown in FIG. 5 or 6. This progressive blocking of the aperture 48 by the piston 40 changes the flow of exhaust gas through the aperture 48 as a function of the centrifugal force exerted on the piston 40. This centrifugal force, in turn, is a function of the rotational speed of the propeller 10. Therefore, the flow of exhaust gas through the aperture of the housing can be controlled as an inverse function of the rotational speed of the propeller 10 about its axis of rotation 20. When the rotation is relatively slow, exhaust gases are free to flow through the aperture 48 and first port 71 to regions where the exhaust gas can aerate the blades 18 of the propeller 10. This is beneficial because the aeration allows the propeller to rapidly increase in rotational speed to engine speeds which are more advantageous in terms of providing increased thrust. As the rotational speed of the propeller increases, in response to the aeration, the piston 40 moves radially outward away from the axis of rotation to begin to block the aperture 48. This, in turn, decreases the flow of exhaust gas through the first port 71 and into aerating relation with the blades 18 of the propeller. Eventually, as the speed of the propeller increases, the piston moves into completely blocking association with the aperture and, in certain embodiments of the present invention, aeration of the blades ceases. In the embodiment shown in FIG. 6, however, a certain amount of aeration continues from the secondary flow passing through the second port 72 in the second end 62 and through the vent 100 formed in the piston 40.

In FIGS. 7-10, the present invention will be empirically compared to a 26-inch pitch propeller and a 24-inch pitch propeller which do not incorporate the valve of the present invention. The present invention, as used in these comparisons shown in FIGS. 7-10, is a modified 26-inch pitch propeller that incorporates three valves made in accordance with a preferred embodiment of the present invention. Although the most relevant comparison in FIGS. 7-10 is between the 26-inch pitch propeller with the present invention and the 26-inch pitch propeller without the present invention, the 26-inch pitch propeller with the present invention is also compared to the 24-inch pitch propeller to show that the present invention not only improves the operation of the 26-inch pitch propeller but, in addition, achieves performance results that are comparable to the 24-inch pitch propeller and, in some cases, exceeds the performance of the 24-inch pitch propeller.

FIGS. 7-10 show empirically derived data associated with the use of the present invention. The graphical representations of FIGS. 7-10 compare a 26-inch pitch propeller 111, a 24-inch pitch propeller 112, and a 26-inch pitch propeller with the present invention installed in the outer hub 12. The results obtained through the use of the present invention in association with a 26-inch pitch propeller are identified by reference numeral 113.

Figure 7:
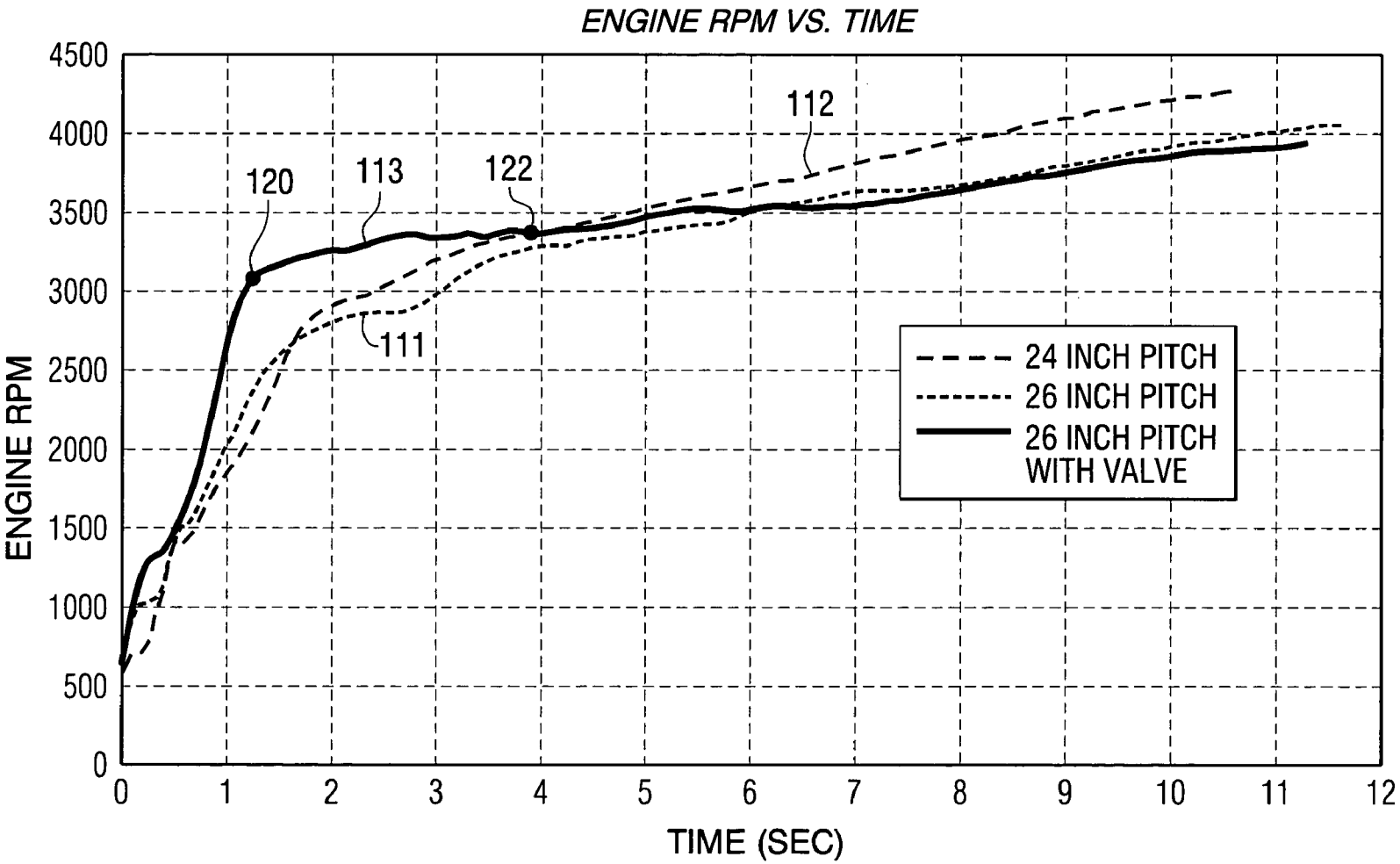
FIG. 7 is a graphical representation of engine speed versus time.

FIG. 7 shows the engine RPM plotted as a graphical function of time. In all examples illustrated in FIGS. 7-10, the engine is accelerated from idle speed to wide open throttle (WOT) speed suddenly.

In FIG. 7, it can be seen that the engine speed rapidly increases to approximately 3200 RPM within a period which is less than 1.5 seconds. During that increase in engine speed, and the associated rotational speed increase of the propeller, the piston 40 of the present invention is forced radially outward by the centrifugal force on it. When the aperture 48 is closed, aeration of the blades 18 ceases and the rapid increase in engine speed slows. This occurs approximately at the point identified by reference numeral 120 in FIG. 7. Beyond point 120, the aperture 48 is essentially blocked by the piston 40. However, a significant benefit is achieved in the rapid acceleration of the propeller 10 within the first 1.5 seconds shown in FIG. 7. This advantage in engine and propeller speed, compared to the 26-inch pitch propeller 111 and the 24-inch pitch propeller 112, continues until point 122 in FIG. 7 which is slightly less than four seconds. However, it should be realized that this initial four seconds of increased propeller speed is significantly advantageous in increasing the speed of the boat on which the propeller is used. Eventually, beyond point 122, the 24-inch propeller 112 exceeds the engine RPM of the 26-inch pitch propeller with the present invention. However, a 24-inch pitch propeller is expected to exceed the rotational speed of a 26-inch pitch propeller and, by the time point 122 is reached, the primary advantages of the present invention have already been achieved by the enhanced acceleration of the boat. It can also be seen that, beyond approximately six seconds, the 26-inch pitch propeller 111 and the modified 26-inch pitch propeller with the present invention achieve virtually identical propeller speed and engine speed profiles.

Figure 8:
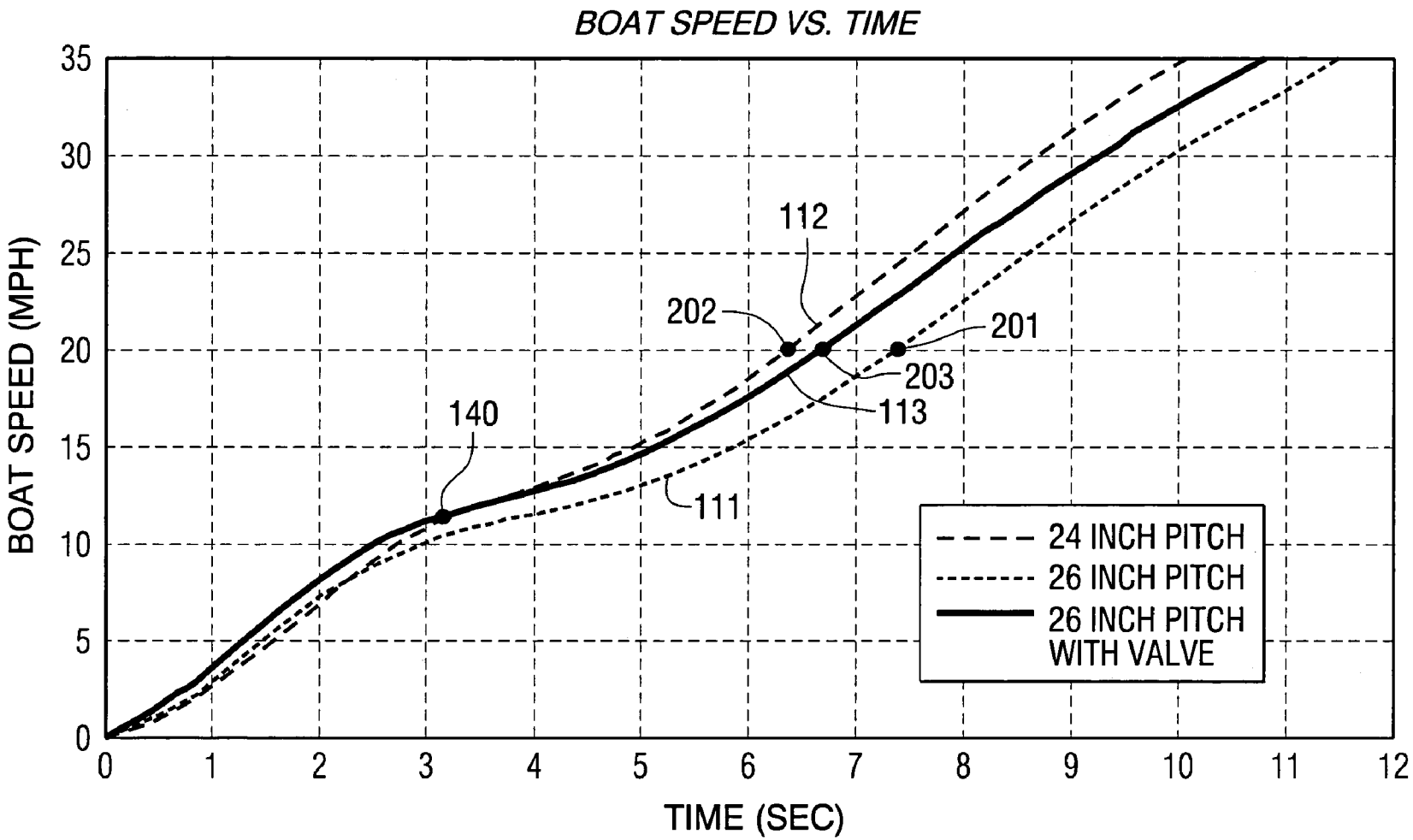
FIG. 8 is a graphical representation of boat speed versus time.

FIG. 8 is a graphical representation of boat speed, in miles per hour, plotted as a function of time. It can be seen that the boat speed achieved through the use of a 26-inch pitch propeller with the present invention included, shown by line 113, exceeds the boat speed of the 24-inch pitch propeller up to point 140, which is beyond three seconds. Compared to the 26-inch pitch propeller 111 without the present invention, the 26-inch pitch propeller with the present invention 113 is superior in boat speed well beyond 11 seconds. Eventually it should be expected that the 26-inch pitch propellers, with or without the present invention, will achieve similar maximum boat speeds since the present invention will likely be operating with the apertures 48 completely blocked by the piston 40, unless the embodiment of the present invention shown in FIG. 6 is used.

With continued reference to FIG. 8, those skilled in the art of marine propulsion typically use the time required to achieve 20 miles per hour as a method for judging the efficiency of a propeller. With reference to points 201-203 in FIG. 8, it can be seen that the 26-inch pitch propeller with the present invention achieves 20 miles per hour at point 203 which is significantly faster than the 26-inch pitch propeller without the present invention at point 201. Point 202 shows the time required for the 24-inch pitch propeller to achieve 20 miles per hour. The difference in time between points 201 and 203 represents the advantage provided by the present invention in comparing two 26-inch propellers, one without the present invention and one with the present invention.

Figure 9:
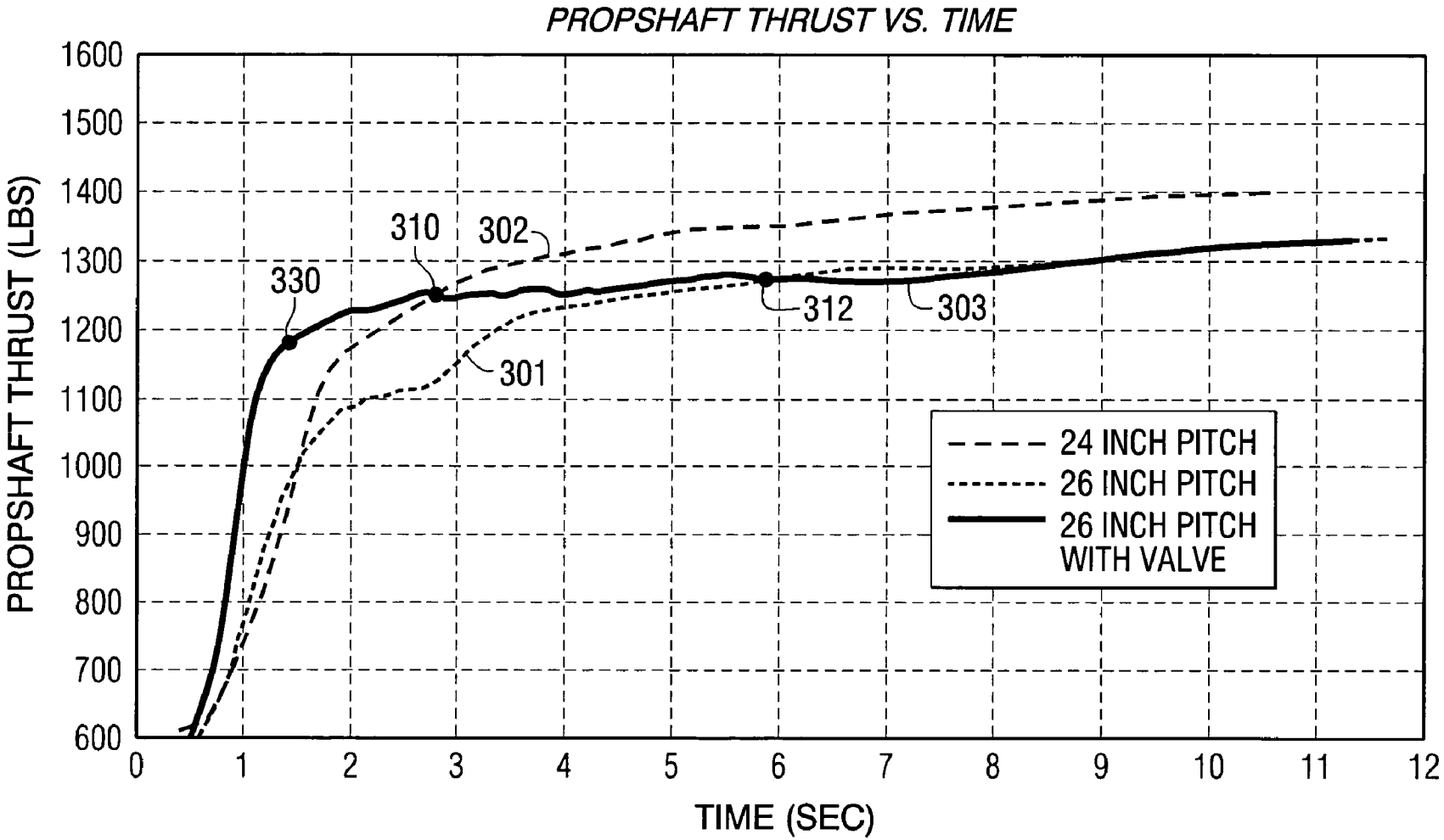
FIG. 9 is a graphical representation of propeller shaft thrust versus time.

FIG. 9 shows the thrust provided by the propellers for a 26-inch pitch propeller 301 without the present invention, a 24-inch pitch propeller without the present invention 302, and a 26-inch pitch propeller with the present invention 303. The prop shaft thrust of the 26-inch propeller with the present invention exceeds the thrust provided by a 24-inch pitch propeller without the present invention up to point 310 which is slightly less than three seconds. In addition, comparing similar propellers, with and without the present invention, shows that the present invention provides increased thrust up to point 312 compared to a 26-inch pitch propeller 301 without the present invention. Again, it should be noted that point 330 represents the approximate time when the piston 40 moves into blocking association with the aperture 48.

Figure 10:
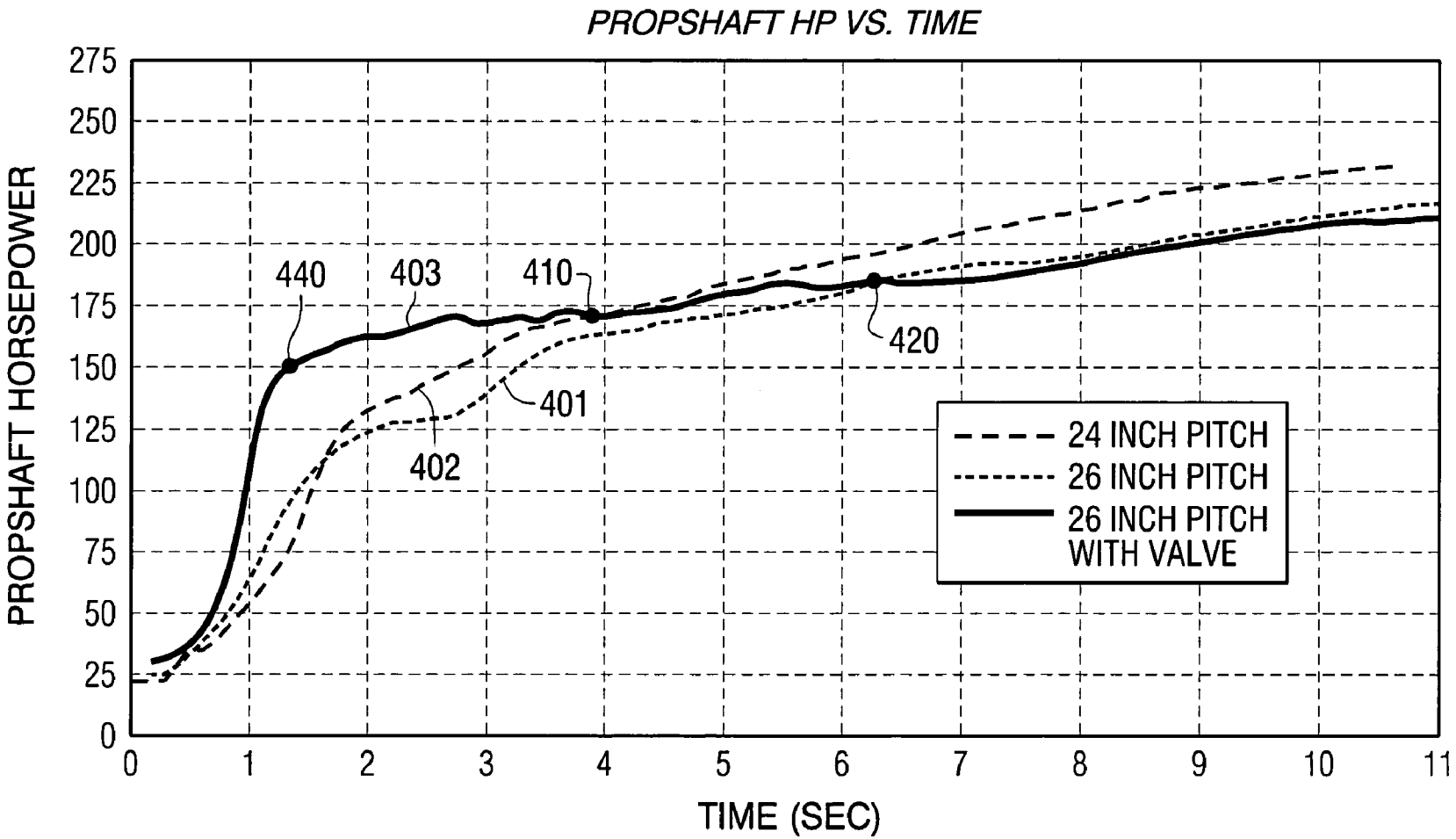
FIG. 10 is a graphical representation of propeller shaft horsepower versus time.

FIG. 10 represents a graphical illustration of propeller shaft horsepower over time. The 26-inch pitch propeller with the present invention 403 provides improved horsepower, in comparison with the 24-inch pitch propeller without the present invention for approximately four seconds, up to point 410, and provides greater horsepower up to point 420 than the 26-inch pitch propeller without the present invention. Beyond point 420, which exceeds six seconds, the 26-inch pitch propeller with the present invention and the 26-inch pitch propeller without the present invention perform similarly, as is expected since the piston of the present invention is expected to be completely blocking the aperture at those times. In fact, as discussed above, it is expected that the piston 40 moves into complete blocking relationship with the aperture 48 at approximately the time represented by point 440 in FIG. 10.

With reference to FIGS. 1-10, it can be seen that a marine propeller made in accordance with a preferred embodiment of the present invention comprises an outer hub 12, a plurality of blades 18 extending from the outer hub 12 in a radial direction from an axis of rotation 20, an inner hub 14 attached to the outer hub 12, an opening 30 extending radially through the outer hub 12, and a valve 34 disposed in the opening 30 and extending into the passage 24 defined between the inner and outer hubs, 14 and 12. The inner and outer hubs, 14 and 12, are configured to be coaxial with each other and with an axis of rotation 20 of the marine propeller 10. The inner and outer hubs, 14 and 12, define the passage 24 therebetween. The opening 30 extends through the outer hub 12. The valve 34 comprises a piston 40 that is slidably disposed in a central cavity 42 of the cylindrical housing. A resilient member 46, such as a coil spring, is disposed within the cavity 42 and configured to urge the piston 40 in a radially inward direction toward the axis of rotation 20. The cylindrical housing has an aperture 48 through a cylindrical wall of the cylindrical housing. The aperture 48 connects the passage 24 in fluid communication with the central cavity 42. The aperture 48 and the piston 40 are configured to cause the piston 40 to progressively block the aperture 48 in response to movement of the piston away from the axis of rotation 20. The cylindrical housing has a first end 61 and a second end 62. The first end 61 is disposed farther from the axis of rotation 20 than the second end 62. The cylindrical housing has a first port 71 formed through the first end 61. The first port 71 is configured to connect the central cavity 42 with a region radially outward from and proximate the outer cylindrical surface of the outer hub 12. The cylindrical housing is spaced apart from the inner hub 14. The resilient member 46 is a spring, in a preferred embodiment of the present invention, which is disposed within the cylindrical housing between the piston 40 and the first end 61.

In a preferred embodiment of the present invention, the cylindrical housing has a circular cross section but, in alternative embodiments, the cross section can be any other shape which is appropriate for retaining the piston during its movement from an unblocking position relative to the aperture 48 to a blocking position. The cylindrical housing in a preferred embodiment of the present invention comprises a first portion 51 having the first end 61 and a second portion 52 comprising the second end 62. The first and second portions, 51 and 52, are removably attachable to each other.

With continued reference to FIGS. 1-10 and specific reference to FIG. 2, the first portion 51 is shaped to be received within the opening 30 in a direction toward the axis of rotation 20 from a position radially outward from the outer hub 12. The second portion 52 is shaped to be moved into attachment with the first portion 51 in a direction away from the axis of rotation 20 from a position radially inward from the outer hub 12. The piston 40 and spring 46 are placed in the cavity 42 of the second portion 52 as it is moved radially outward toward the opening 30. The first portion 51 is moved radially inward toward the opening 30 and into locking relation with the second portion 52. In a particularly preferred embodiment of the present invention, the first and second portions, 51 and 52, are molded from plastic and snap together after they are both moved toward each other and toward the opening 30.

With continued reference to FIGS. 1-10, the cylindrical housing has a second port 72 formed through its second end 62. In certain embodiments of the present invention, such as that shown in FIG. 6, the piston 40 has a vent 100 formed through its thickness. The cylindrical housing is configured to provide first and second flow paths between the passage 24 and the region radially outward from the outer hub 12. The first flow path extends through the aperture 48 and the second flow path extends through the vent 100 and second port 72.

With continued reference to FIGS. 1-10 and particular reference to FIGS. 7-10, it can be seen that the progressive blocking of the aperture 48 by the piston 40 affects the operation of the propeller in an advantageous way. Since the rotation of the propeller changes directly in synchrony with the rotation of the crankshaft of the engine, engine RPM is accurately indicative of the rotational speed of the propeller. The unblocked aperture 48 causes a more rapid increase in engine RPM because it allows aeration to occur with respect to the blades of the propeller. In FIG. 7, the rapid increase in engine RPM that results from the flow of exhaust gas through the aperture 48 is illustrated in the portion of line 113 during the first second of operation, up to point 120. During the first second of operation, the piston 40 moves radially outwardly to block the aperture 48, first progressively and then completely. With the aperture 48 blocked by the piston 40, the engine RPM continues to increase, but at a slower rate, as illustrated in FIG. 7 beyond point 120. Similarly, the boat speed is improved as illustrated in FIG. 8 during the first three seconds of operation, up to point 140. The propeller shaft thrust similarly benefits from the present invention as illustrated by the rapid increase to point 330 in FIG. 9. The prop shaft horsepower, illustrated in FIG. 10, shows a similar benefit with a rapid increase to point 440 as the piston 40 moves from an unblocking to a blocking position relative to the aperture 48.

Although the present invention has been shown in a specific embodiment, it should be understood that alternative embodiments are also within its scope.

We claim:

1. A marine propeller, comprising:

an outer hub;

a plurality of blades extending from said outer hub in a radial direction;

an inner hub attached to said outer hub, said inner and outer hubs being configured to be coaxial with each other and with an axis of rotation of said marine propeller, said inner and outer hubs defining a passage therebetween;

an opening extending radially through said outer hub; and a valve disposed in said opening and extending into said passage, said valve comprising a piston slidably disposed in a central cavity of a housing, a resilient member disposed within said cavity and configured to urge said piston in a radially inward direction toward said axis of rotation, said housing having an aperture through said housing, said aperture connecting said passage in fluid communication with said central cavity, said aperture and said piston being configured to cause said piston to progressively block said aperture in response to movement of said piston away from said axis of rotation, said housing having a first end and a second end, said first end being disposed farther from said axis of rotation than said second end, said housing having a first port formed through said first end, said first port being configured to connect said central cavity with a region radially outward from said outer hub, wherein said housing has a second port formed through said second end.

2. The marine propeller of claim 1, wherein:

said piston has a vent formed through its thickness.

3. The marine propeller of claim 2, wherein:

said housing is configured to provide first and second flow paths between said passage and said region radially outward from said outer hub, said first flow path extending through said aperture and said second flow path extending through said vent.

4. The marine propeller of claim 3, wherein:

said first and second flow paths are operable simultaneously.

5. A marine propeller, comprising:

an outer hub;

a plurality of blades extending from said outer hub in a radial direction;

an inner hub attached to said outer hub, said inner and outer hubs being configured to be coaxial with each other and with an axis of rotation of said marine propeller, said inner and outer hubs defining a passage therebetween;

an opening extending radially through said outer hub; and a valve disposed in said opening and extending into said passage, said valve comprising a piston slidably disposed in a central cavity of a housing, a resilient member disposed within said cavity and configured to urge said piston in a radially inward direction toward said axis of rotation, said housing having an aperture through said housing, said aperture connecting said passage in fluid communication with said central cavity, said aperture and said piston being configured to cause said piston to progressively block said aperture in response to movement of said piston away from said axis of rotation, said housing having a first end and a second end, said first end being disposed farther from said axis of rotation than said second end, said housing having a first port formed through said first end, said first port being configured to connect said central cavity with a region radially outward from said outer hub, wherein said housing is spaced apart from said inner hub.

6. A marine propeller, comprising:

an outer hub;

a plurality of blades extending from said outer hub in a radial direction;

an inner hub attached to said outer hub, said inner and outer hubs being configured to be coaxial with each other and with an axis of rotation of said marine propeller, said inner and outer hubs defining a passage therebetween;

an opening extending radially through said outer hub; and a valve disposed in said opening and extending into said passage, said valve comprising a piston slidably disposed in a central cavity of a cylindrical housing, a resilient member disposed within said cavity and configured to urge said piston in a radially inward direction toward said axis of rotation, said cylindrical housing having an aperture through a cylindrical wall of said cylindrical housing, said aperture connecting said passage in fluid communication with said central cavity, said aperture and said piston being configured to cause said piston to progressively block said aperture in response to movement of said piston away from said axis of rotation, said cylindrical housing having a first end and a second end, said first end being disposed farther from said axis of rotation than said second end, said cylindrical housing having a first port formed through said first end, said first port being configured to connect said central cavity with a region radially outward from said outer hub, said cylindrical housing being spaced apart from said inner hub, said resilient member being a spring disposed within said cylindrical housing between said piston and said first end.

7. The marine propeller of claim 6, wherein:

said cylindrical housing has a circular cross section.

8. The marine propeller of claim 6, wherein:

said cylindrical housing comprises a first housing portion comprising said first end and a second cylindrical housing portion comprising said second end, said first and second housing portions being removably attachable to each other.

9. The marine propeller of claim 8, wherein:

said first housing portion is shaped to be received within said opening in a direction toward said axis of rotation from a position radially outward from said outer hub; and said second housing portion is shaped to be moved into attachment with said first housing portion in a direction away from said axis of rotation from a position radially inward from said outer hub.

10. The marine propeller of claim 6, wherein:

said cylindrical housing has a second port formed through said second end.

11. The marine propeller of claim 10, wherein:

said piston has a vent formed through its thickness, said cylindrical housing being configured to provide first and second flow paths between said passage and said region radially outward from said outer hub, said first flow path extending through said aperture and said second flow path extending through said vent.

12. A marine propeller, comprising:

an outer hub;

a plurality of blades extending from said outer hub in a radial direction;

an inner hub attached to said outer hub, said inner and outer hubs being configured to be coaxial with each other and with an axis of rotation of said marine propeller, said inner and outer hubs defining a passage therebetween;

an opening extending radially through said outer hub; and a valve disposed in said opening and extending into said passage, said valve comprising a piston slidably disposed in a central cavity of a housing, said housing being generally cylindrical, a resilient member disposed within said cavity and configured to urge said piston in a radially inward direction toward said axis of rotation, said housing having an aperture through said housing, said aperture connecting said passage in fluid communication with said central cavity, said aperture and said piston being configured to cause said piston to progressively block said aperture in response to movement of said piston away from said axis of rotation, said housing having a first end and a second end, said first end being disposed farther from said axis of rotation than said second end, said housing having a first port formed through said first end, said first port being configured to connect said central cavity with a region radially outward from said outer hub, said housing comprising a first housing portion and a second housing portion, said first housing portion comprising said first end and said second housing portion comprising said second end, said first and second housing portions being removably attachable to each other, said housing having a second port formed through said second end, said second end of said housing being spaced apart from said inner hub.

13. The marine propeller of claim 12, wherein:

said housing has a circular cross section.

14. The marine propeller of claim 12, wherein:

said first housing portion is shaped to be received within said opening in a direction toward said axis of rotation from a position radially outward from said outer hub; and said second housing portion is shaped to be moved into attachment with said first housing portion in a direction away from said axis of rotation from a position radially inward from said outer hub.

15. The marine propeller of claim 14, wherein:

said piston has a vent formed through its thickness, said housing being configured to provide first and second flow paths between said passage and said region radially outward from said outer hub, said first flow path extending through said aperture and said second flow path extending through said vent.

* * * * *